US006315695B1

(12) United States Patent
Follett et al.

(10) Patent No.: US 6,315,695 B1
(45) Date of Patent: Nov. 13, 2001

(54) TRI-PLANAR CONTROLLER MOTION REHABILITATION AND EXERCISE PLATFORM

(76) Inventors: Michael R. Follett, 3065 Ave. E, Billings, MT (US) 59102; Todd A. Sisson, 31 Wrangler Dr., Bozeman, MT (US) 59718

( * ) Notice: Subject to any disclaimer, the term of this patent is extended or adjusted under 35 U.S.C. 154(b) by 0 days.

(21) Appl. No.: 09/484,872

(22) Filed: Jan. 18, 2000

(51) Int. Cl.[7] ..... A63B 22/16
(52) U.S. Cl. ..... 482/34; 482/146; 482/79
(58) Field of Search ..... 482/34, 79, 146; 446/325, 396

(56) References Cited

U.S. PATENT DOCUMENTS

| | | | |
|---|---|---|---|
| 3,063,714 | 11/1962 | Krauss . | |
| 3,188,087 | 6/1965 | Larson . | |
| 3,352,559 | 11/1967 | Larsen . | |
| 3,806,116 | 4/1974 | Malmberg et al. . | |
| 4,191,371 | 3/1980 | Armer . | |
| 4,653,748 | 3/1987 | Seel et al. . | |
| 4,759,542 | 7/1988 | Hudec . | |
| 5,328,421 | 7/1994 | Stamalajczo . | |
| 5,399,140 | 3/1995 | Klippel . | |
| 5,613,690 | 3/1997 | McShane . | |
| 5,643,164 | 7/1997 | Teff . | |
| 5,810,703 | 9/1998 | Stack | 482/146 |
| 5,897,474 * | 4/1999 | Romero | 482/146 |

FOREIGN PATENT DOCUMENTS

| | | |
|---|---|---|
| 2592802 | 7/1987 | (FR) . |
| 9408664 | 4/1994 | (WO) . |

* cited by examiner

*Primary Examiner*—Glenn E. Richman
(74) *Attorney, Agent, or Firm*—Richard C. Conover

(57) ABSTRACT

A rehabilitation and exercise device for facilitating and limiting motion and biomechanical forces along the horizontal and vertical axes in the saggital, frontal, and transverse planes of the human anatomy. The device consists of an elongated, substantially flat platform with somewhat rounded corners (24). The platform is made of a rigid material to prevent fracturing and bending and is further supported on the bottom surface by central support spines (30) and peripheral support spines (16). The platform provides a decreased slip top surface (10) by utilizing a recessed grid (20). The bottom surface of the platform (12) is configured with a larger diameter central platform attachment extension (28) and smaller diameter peripheral platform attachment extensions (32) which have internal recesses (14) configured at a predetermined set of points to accommodate rigid, somewhat rounded pegs (18) of varying shape and diameter. The peg attachments are secured to the bottom surface of the platform with a peg attachment insert screw (34) which rotates into a heilcoil (26) located in the internal recess. The platform allows specific facilitation or limitation of motion and biomechanical forces along the horizontal and vertical axes depending on the placement of human anatomy on the top surface (10) and peg size and placement on the bottom surface (12) of the platform.

7 Claims, 7 Drawing Sheets

TRI-PLANAR CONTROLLER MOTION REHABILITATION AND EXERCISE PLATFORM

CROSS REFERENCE TO RELATED APPLICATIONS

Not applicable.

BACKGROUND

1. Field of Invention

This invention relates to a rehabilitation and exercise device for facilitation or limitation of saggital, frontal and transverse plane motion and biomechanical forces along the horizontal and vertical axes for the human anatomy.

2. Description of Prior Art

Rehabilitation and preventative medicine use a variety of treatment modalities to achieve optimal function for the human body. One treatment area that has received significant attention is the rehabilitation and retraining of muscular and neurological anatomy and physiology of the trunk lower extremities and upper extremities. One method of rehabilitation and retraining consists of closed-chain exercise and biomechanics where the distal appendage is fixed on a surface. This allows rehabilitation and retraining of the human anatomy to occur within a functional environment. There are three cardinal planes of motion in which functional movement occurs around a horizontal and vertical axis of motion. The saggital plane consists of anterior-posterior motion, the frontal plane consists of medial-lateral motion, and the transverse plane consists of rotational motion. Rehabilitation and exercise in these three planes of motion have been partially addressed through a variety of balance platforms, wobble and sport boards, and exercise devices.

Inventors have continued to create several types of devices to address closed chain rehabilitation and retraining of the human anatomy. U.S. Pat. No. 4,653,748 to Seel et al (1987) discloses a biomechanical and platform system developed for retraining muscular and neurological physiology of the ankle. This device is a spherical platform designed specifically for the ankle that allows for only a unilateral stance position and facilitates motion exclusively in the transverse plane. Thus, it is not able to control or facilitate motion for two extremities simultaneously and does not control or facilitate motion in the frontal or saggital plane, limiting rehabilitation and exercise applications.

U.S. Pat. No. 3,806,116 to Malaberg et al (1974) discloses a balancing device for amusement or athletic purposes comprising a circular, flat platform with a plurality of recesses of different configurations formed in its underside and distributed in a spaced relationship. Although the device and its recesses allow tiltable motion based on the position of the supportable members, the platforms circular nature and the equidistant nature of the recesses from the central penetration, limit bilateral lower extremity and upper extremity facilitation or limitation of motion and biomechanical forces. Also, the circular nature of the platform limits the base of support width for bilateral lower extremity and upper extremity applications.

U.S. Pat. No. 5,897,474 to Romero (1999) discloses a rectangular shaped platform that utilizes a semi flexible ball member allowing motion in various directions to produce muscle, tendon, and joint stretching movements. The ball-shaped rigid members are mounted adjacent to and on opposite sides of the central opening to allow for both balancing and securing the semi-flexible ball attachment in the central opening. Although the device produces movement in various planes of motion, it does not produce consistent, controlled motion due to compression of the semi-flexible ball attachment depending on the user's weight. This also produces a much steeper and uncontrolled angle of drop that is not conducive for post-acute injuries or for populations with significant neurological or musculoskeletal impairment. Additionally, the lack of attachment points for the rigid attachments and their location adjacent to the center opening, limits the directional control and options for rehabilitation and exercise programs.

Several other types of other balancing devices, exercise platforms, and sport boards have been proposed—for example, U.S. Pat. No. 3,063,714 to Krauss (1962). This exercising device produces motion exclusive to the transverse plane due to recess placement and reliance on a base platform and ball bearing attachment. Thus, the transverse plane motion is difficult to control for the user due to a lack of peripheral recesses. U.S. Pat. No. 3,352,559 to Larsen (1964) discloses a pivoted combination game board and exercising device that produces motion exclusive to the frontal plane and lacks internal recesses on the bottom of the board to limit or facilitate motion in the frontal plane. Similarly, U.S. Pat. No. 5,643,164 to Teff (1997) discloses a rectangular rocker board that produces motion exclusive to the frontal plane for the foot and lower extremities. U.S. Pat. No. 5,810,703 to Stack (1998) also consists of a wobble board exclusive to the frontal plane with bolts extending from the board for attachment of hemi-spherical attachments. Also, this platform allows for only two heights of motion control in the frontal plane based on the attachment position.

U.S. Pat. No. 4,191,371 to Armer (1980) discloses a balancing apparatus that operates by moving on a spherical fulcrum that rotates about its othogonal axes. This produces motion in a multitude of directions, specific to the transverse plane, based on placement of a stop means on the platform. This does not allow for a consistent means of controlling motion and biomechanical forces in all three planes or for unilateral and bilateral placement of the lower extremities, upper extremities, or trunk.

Other types of balancing and rehabilitation training devices and sport boards have been proposed—for example, in U.S. Pat. No. 5,399,140 to Klippel (1995) which discloses an elongated platform that receives a participant as well as moving on track rails. The bottom surface attaches to a rectangular plank providing linear motion exclusive to one plane and not allowing for reproducible, controlled motion including angle of tilt for all three planes of motion. U.S. Pat. No. to 5,613,690 to McShane (1997) discloses a balance platform with a spherically shaped concave depression that rests upon a base platform of convex support thereby producing a proprioceptive challenge in the transverse plane. Further, this device does not have recesses located between the two platforms to control all three planes of motion and biomechanical forces specific to each plane.

All balance, exercise, and rehabilitation platforms heretofore known suffer from a number of disadvantages:

(a) Their design does not allow for the limitation or facilitation of motion and biomechanical forces around the horizontal and vertical axes producing controllable motion in the saggital, frontal and transverse planes.

(b) Their design does not allow reproducible rehabilitation, balance and exercise programs for the trunk, unilateral or bilateral lower extremities, and upper extremities in the saggital, frontal and transverse planes.

(c) Their design does not allow for attachments of various size and shape at predetermined points via recesses at the center and periphery of the platform that limit or facilitate motion and biomechanical forces in the saggital, frontal and transverse planes.

SUMMARY

In accordance with the present invention a unique rehabilitation and exercise platform that facilitates or limits saggital, frontal and transverse planes motion and biomechanical forces along the horizontal and vertical axes in for the trunk, unilateral or bilateral lower extremities, and upper extremities.

OBJECTS AND ADVANTAGES

Accordingly, besides the objects and advantages of the rehabilitation and exercise platform described above in our patent, several objects and advantages of the present invention are:

(a) to provide a rehabilitation and exercise platform that facilitates or limits motion and biomechanical forces in the saggital, frontal and transverse planes for the trunk and unilateral or bilateral lower extremities, and upper extremities;

(b) to provide a rehabilitation and exercise platform for people of all ages with orthopedic or neurological dysfunction;

(c) to provide a rehabilitation and exercise platform to address balance, coordination and musculoskeletal disorders around the horizontal and vertical axes in the three cardinal planes of motion;

(d) to provide a rehabilitation and exercise platform which enhances functional rehabilitation and retraining of the lower extremities, upper extremities and trunk in the three cardinal planes of motion for all patient populations;

(e) to provide a rehabilitation and exercise platform which allows a decreased slip surface with an imprinted angular measuring grid;

(f) to provide a rehabilitation and exercise platform which allows reproducible patterns of movement and a multitude of closed chain rehabilitation and exercise programs;

(g) to provide a rehabilitation and exercise platform that facilitates or limits the biomechanical forces of weight-bearing and gait, including stride length and anterior, posterior, medial, lateral and transverse weight shift;

(h) to provide a rehabilitation and exercise platform which allows appropriate postural control in all three cardinal planes of motion for the lower extremities, upper extremities and trunk in the upright position;

(i) to provide a rehabilitation and exercise platform which allows upper extremity closed-chain motion and rehabilitation exercises in the three cardinal planes of motion;

(j) to provide a rehabilitation and exercise platform which allows for a progression of balance and safety awareness in the three cardinal planes of motion for reducing fall risk and falls;

(k) to provide a rehabilitation and exercise platform which allows a multitude of foot, hand or trunk placements;

(l) to provide a rehabilitation and exercise platform which create a unique and customized training environment based on a multitude of member attachment points, shapes, and sizes;

(m) to provide a rehabilitation and exercise platform which allows for photographs or video of the user in a unilateral or bilateral position of the upper and lower extremities to document progress with a high degree of inter-rater reliability in all three cardinal planes of motion;

Further objects and advantages are to provide a rehabilitation and exercise platform which allows a multitude of rigid peg attachments, both in size, diameter and location, that control all three cardinal planes of motion around the horizontal and vertical axes of motion, which has a multitude of internal recesses placed at predetermined points for peg attachment, which allows varying degrees of tilt angle in the saggital, frontal, and transverse plane, which allows reproducible treatment in all three planes of motion, which allows a decreased slip surface with an imprinted angular measuring grid, and which allows a multitude of closed chain rehabilitation and exercise applications to various areas of the human anatomy. Still further objects and advantages will become apparent from a consideration of the ensuing description and drawings.

DRAWING FIGURES

Reference Numerals in Drawings

| | | | |
|---|---|---|---|
| 10 | Top surface of platform | 12 | Bottom surface of platform |
| 14A–14I | Peg mounting recesses | 16 | Peripheral support spines |
| 18 | Peg attachments | 20 | Imprinted angular measuring grid |
| 22 | Handle openings | | |
| 26 | Helicoil | 24 | Comers |
| 30 | Central support spines | 28 | Tilt peg mount |
| 34 | Peg attachment insert screw | 32 | Stop peg mount |

DESCRIPTION—FIGS. 1–3—PREFERRED EMBODIMENT

Figure 1:
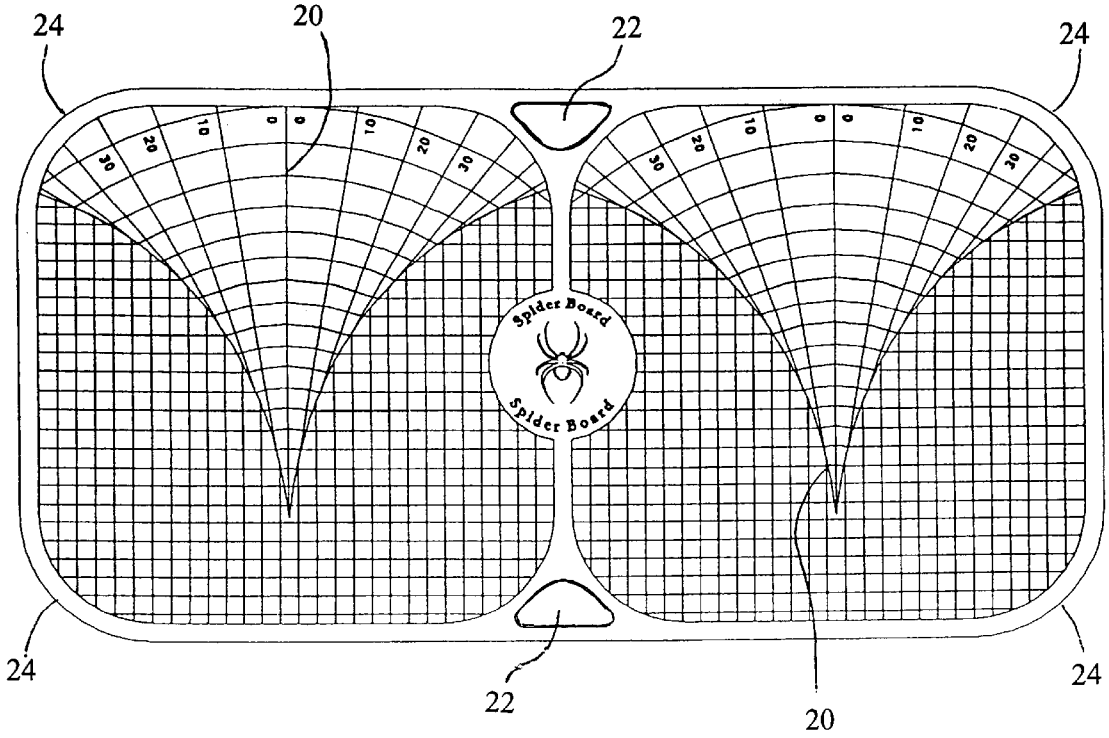
FIG. 1 shows the top surface of the platform including imprinted angular measuring grid.
Figure 2:
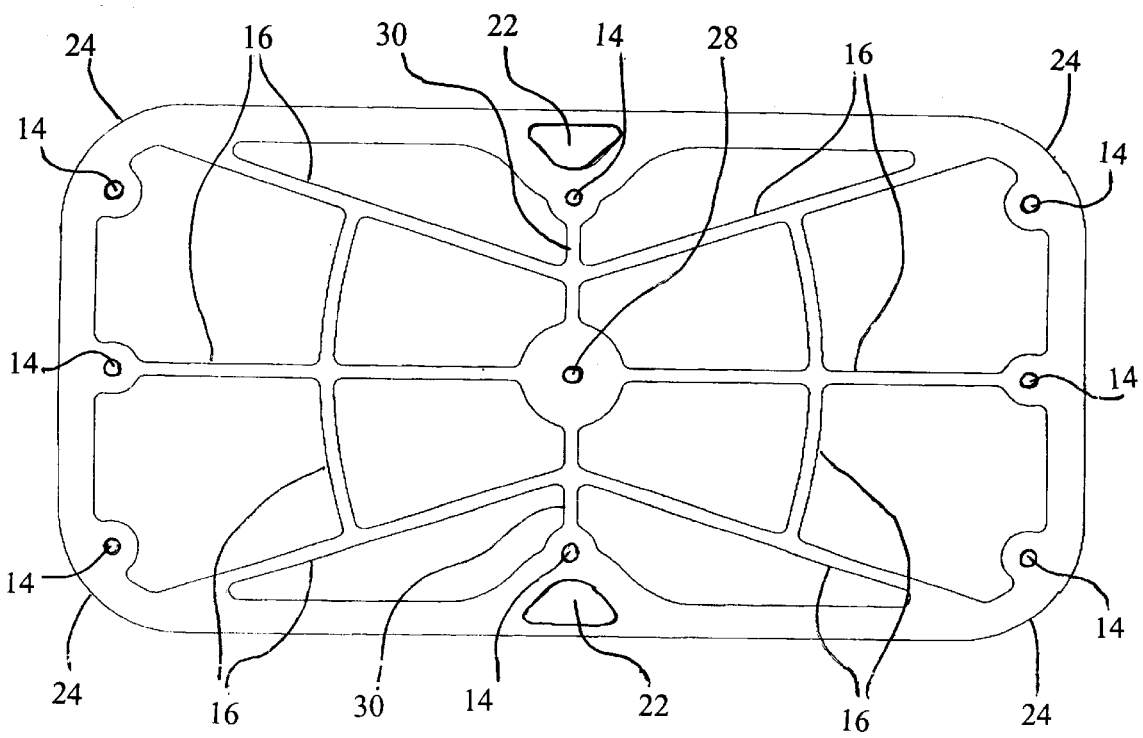
FIG. 2 shows the bottom surface of the platform.
Figure 3A:
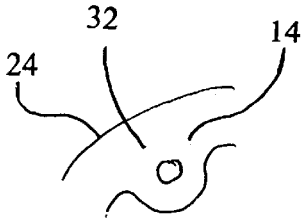
FIG. 3A to 3I shows the bottom view of the various attachment extensions in the bottom of the platform.
Figure 3B:
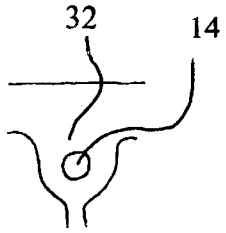
Figure 3C:
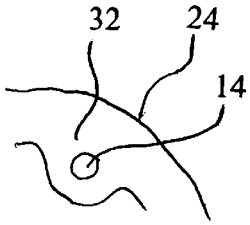
Figure 3D:
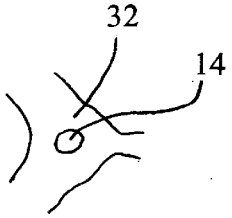
Figure 3E:
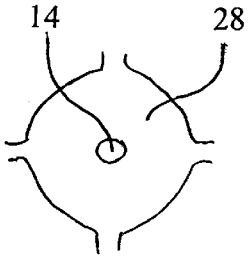
Figure 3F:
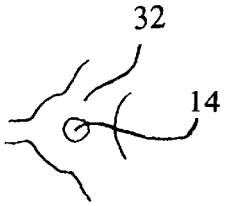
Figure 3G:
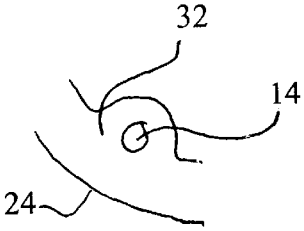
Figure 3H:
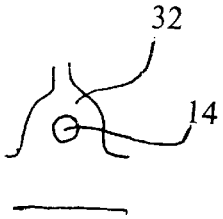
Figure 3I:
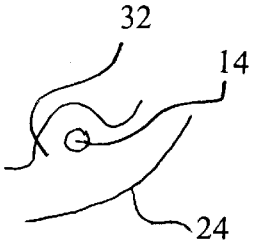

A preferred embodiment of the platform is illustrated in FIG. 1 (top view) and FIG. 2 (bottom view). The platform is comprised of a rigid material such as 60/61 aluminum that can sustain heavier masses without fracturing or compromising the structural integrity of the platform. The platform is further supported by rigid central support spines 30 and peripheral support spines 16 built into the substantially recessed bottom surface of the platform. At the center location on the bottom surface a larger diameter central platform extension 28 with an internal recess 14A is positioned for peg attachment 18. At predetermined points along the peripheral edge of the bottom surface are peripheral platform attachment extensions 32 with internal recesses for peg attachments 14B–14I. The internal recesses are comprised of a helicoil 26 that allow for quickly attaching or removing peg attachments 18. The helicoil 26 increases the rigidity of the platform and allows for contiguous peg attachment.

The base of the platform is about 1.5 cm to 2.0 cm in thickness, and has overall dimensions roughly from 74 cm in length by 39 cm in width. The peripheral platform attachment extensions 32 on the platform are located at predetermined points roughly 12 cm to 35 cm from the central platform attachment extension 28. The internal recesses 14A–14I inclusive of the helicoil 26 are about 1.0 cm in diameter by 1.5 cm in depth. The internal recesses are imbedded in the roughly rounded peripheral platform attachment extensions 32 and central platform attachment extension 28 that allow for contiguous peg attachment and allows the platform to rest flat against a level surface when peg attachments 18 are not attached to platform. The dimensions are roughly 7.5 cm in diameter for the central platform attachment extension 28 to roughly 4.0 cm for the peripheral platform attachment extensions 32. The peg attachments 18 range from roughly 2.5 cm in height and 4.0 cm in diameter to roughly 8.0 cm in height to 8.0 cm in diameter. Each peg has a peg attachment insert screw 34 protruding roughly 1.0 cm from its center that rotates into the recessed helicoil 26.

The outer four corners 24 of the platform are typically beveled or rounded to avoid injury and allow for smooth contact along the peripheral edge of the platform. The peripheral support spines 16 extend from the central platform attachment extension 28 and central support spines 30 to the peripheral edge of the platform. The central and peripheral support spines have overall dimensions of about 1.0 cm in width by 1.5 cm in depth and range in length from roughly 7.5 cm for the central support spine 30 to 27.5 cm for the peripheral support spines 16.

The top surface (FIG. 1) of the platform is imprinted with two identical recessed angular measuring grids 20 that allow for a decreased slip surface. The measurement of each imprinted grid 20 is roughly 35.0 cm in length by 35.5 cm in width by 1 mm in depth. Located at the top and bottom of the platform are two openings 22 that serve as handles for transporting the board. These are somewhat triangular in shape with a rounded beveled edge to prevent injury or snagging. The dimensions of the handle openings 22 are roughly 7.0 cm in length by 3.5 cm in width.

Advantages

From the description above, a number of advantages of our Tri-Planar Controlled Motion Rehabilitation and Exercise Platform become evident:

(a) The platform provides a superior tool for closed chain rehabilitation and exercise of the trunk, unilateral or bilateral lower extremities or upper extremities around the horizontal and vertical axes in the three cardinal planes of motion;

(b) The platform allows by multitude of predetermined member attachment points on the bottom surface with central and peripheral platform extensions to facilitate or limit motion and biomechanical forces in the three cardinal planes of motion;

(c) The platform provides a rigid structure with its composition and unique central and peripheral support spines to allow users of large mass to experience a multitude of directional and biomechanical forces of in a controlled, safe environment;

(d) The recessed and imprinted angular measuring grids provide a decreased slip surface for the user;

(e) The static nature of the platform attachment extensions and rigid peg attachments allow for reproducible rehabilitation and exercise programs in the three cardinal planes of motion;

(f) The helicoils in the internal recesses allow for increased contiguity between the platform and peg attachments;

(g) The central and peripheral platform attachment extensions allow for a multitude of peg attachment placement locations and support peg attachments of varying size and diameter, and (h) The elongated nature of the platform along with the beveled and rounded corners allow for an even transition of biomechanical forces and motion for unilateral or bilateral upper extremities and lower extremities in the three cardinal planes of motion.

Operation—FIGS. 1–6

The manner of using the tri-planar controlled motion rehabilitation and exercise platform is similar to other balance and exercise platforms already in use. Namely, one places a part or parts of the human anatomy on a platform that balances on an axis or fulcrum allowing motion to occur in a specific or multitude of directions around the horizontal and vertical axes.

The operation of this invention includes determining the size and diameter of the varying peg attachments 18 and selecting a specific internal recess or multiple internal recesses 14A–14I for placement. The angle of tilt and amount motion in a specific cardinal plane is dependent on the height and placement of the peg attachments. Next, one pivotably attaches the peg attachment by inserting the peg attachment insert screw 34 in a clockwise manner into an internal recess 14 until contiguous at the predetermined points thereby securing the peg attachment to the platform. The platform is then placed on a surface resting on the peg attachment or peg attachments 18 and the distal edge of the platform. Next, one places the trunk, one, or both extremities onto a specific location on the top surface 18 of the platform.

Rehabilitation and exercise of the muscular and neurological anatomy and physiology occurs by moving the platform with the fixed human anatomy along a horizontal or vertical axis determined by the peg attachments 18. The amount of motion and biomechanical forces in the saggital, frontal and transverse planes is determined by the position, size and number of pegs attached to the platform and the position of the fixed human anatomy on the platform. Placing both feet or both hands on the top surface simultaneously allows bilateral rehabilitation and exercise to occur within the principles of closed-chain biomechanics. Placing one foot or one hand on the center of the platform allows unilateral extremity rehabilitation and retraining to occur within the principles of closed-chain biomechanics. Transporting the platform is made easier by two unique handle openings 22 that allow for grasping the board.

Conclusions, Ramifications, and Scope

Accordingly, the reader will see that this rehabilitation and exercise platform creates a unique way to facilitate or limit range of motion and biomechanical forces around the horizontal and vertical axes in the three cardinal planes of motion for the lower extremities, upper extremities and trunk. In addition, the variety and placement of peg attachment points on the platform allow for member attachments of varying diameter and height to create a multitude of rehabilitation and exercise options. The attachment points are comprised of internal recesses with a helicoil to allow for rapid attachment and removal of pegs. Further, the rehabilitation and exercise platform has the additional advantages in that The rigidity of the platform and the support spines located on the bottom surface of the platform allow for individuals of larger mass to use the platform for rehabilitation and exercise programs;

The substantially recessed bottom surface decreases the overall weight of the platform;

It allows for a multitude of peg attachment configurations on the bottom surface of the platform;

It allows for a multitude of peg attachment shapes and sizes to attach to the peg attachment platform extensions;

It provides a superior decreased slip surface that cannot be altered or erased;

It provides a controlled training environment in which the user can exercise and retrain the neurological and muscular physiology and anatomy around both the horizontal and vertical axes safely facilitating or limiting motion in the three cardinal planes;

It permits a rehabilitation and training environment that can be easily adjusted to the strengths and weaknesses of the user;

The imprinted angular measuring grid provides a decreased slip top surface; and

It allows either unilateral or bilateral lower extremity or bilateral upper extremity placement in a multitude of positions on the top surface of the platform.

Figure 4A:
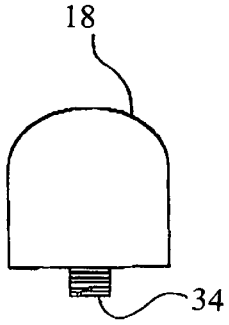
FIGS. 4A to 4F shows the side view of the various peg attachments.

To illustrate the use of the present device, a specific example will now be described with the understanding that many other configurations may be selected to accomplish a particular exercise. For this example, a user is to exercise while standing on platform 10 and tilt the platform from side to side in the frontal plane. First a peg 18, such as shown in FIG. 4A, is selected and screwed into recess 14A. This peg will be referred to hereinafter as a "tilt peg." The rate of tilt is determined by the curvature of peg 18 at its free end, and the desired rate of tilt is obtained by selecting the appropriate tilt peg 18. Next, two pegs 18, such as shown in FIG. 4C, are screwed into recesses 14B and 14F. These two pegs mounted in the peripheral recesses will be hereinafter referred to as "stop pegs." In this particular example, the length of the stop pegs is selected to be the same as the length of the tilt peg. With this configuration, tilting in the anterior/posterior direction is prevented and tilting of the platform from side to side is limited by the edge of the platform engaging the ground surface. To further limit the side-to-side movement of the platform, four additional stop pegs 18 are selected for screwing into recesses 14C, 14E, 14G and 14I. These stop pegs would have the same length but would be shorter than the length of the tilt peg. For example, pegs 18, as shown in FIG. 4A, could be selected. With this configuration, the platform tilts in the saggital plane until the stop pegs located on the lateral edges of the platform engage the ground surface.

From this one-example, it can be seen that various pegs can be selected for motion in the saggital plane and the frontal plane, as well as the transverse plane. The rate of tilt can be selected by selecting opposite tilt pegs 18 and degree of tilt can be limited also by the appropriate placement of stop pegs 18.

The following table describes various other peg configurations for various planes of motion.

Figure 4B:
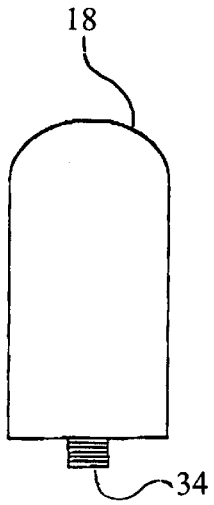
Figure 4C:
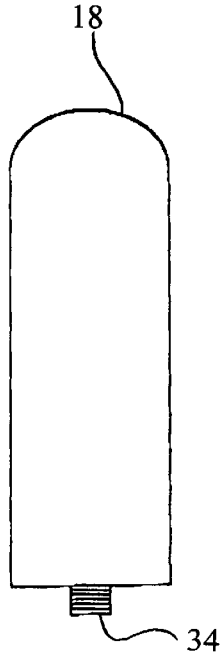
Figure 4D:
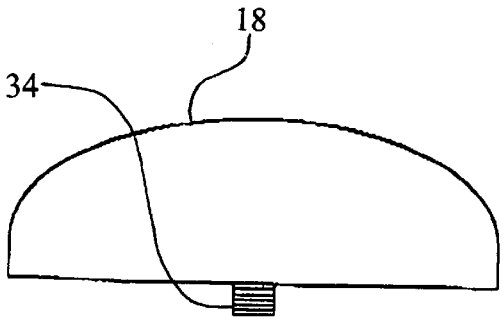
Figure 4E:
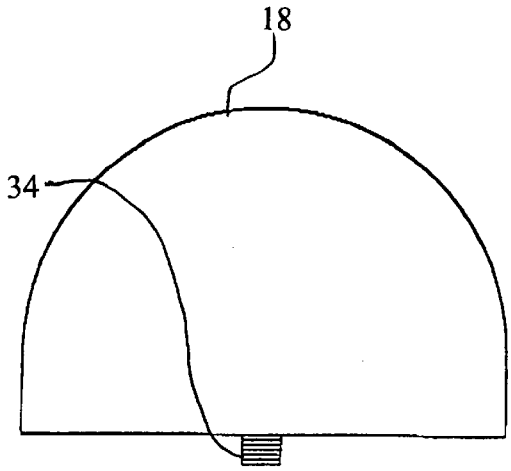
Figure 4F:
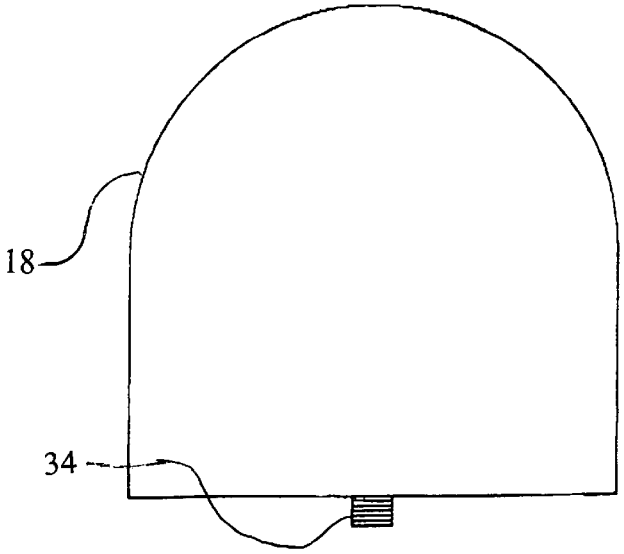
Figure 5A:
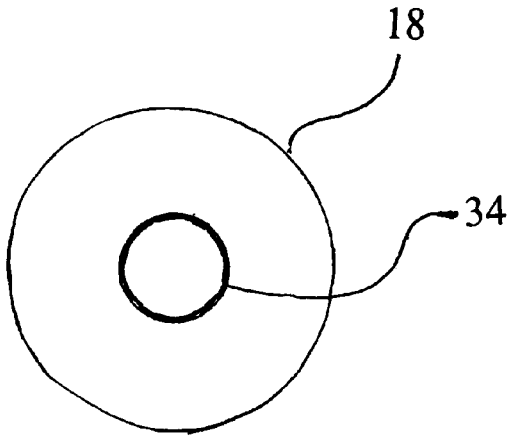
FIGS. 5A to 5B shows the top view of the various peg attachments.
Figure 5B:
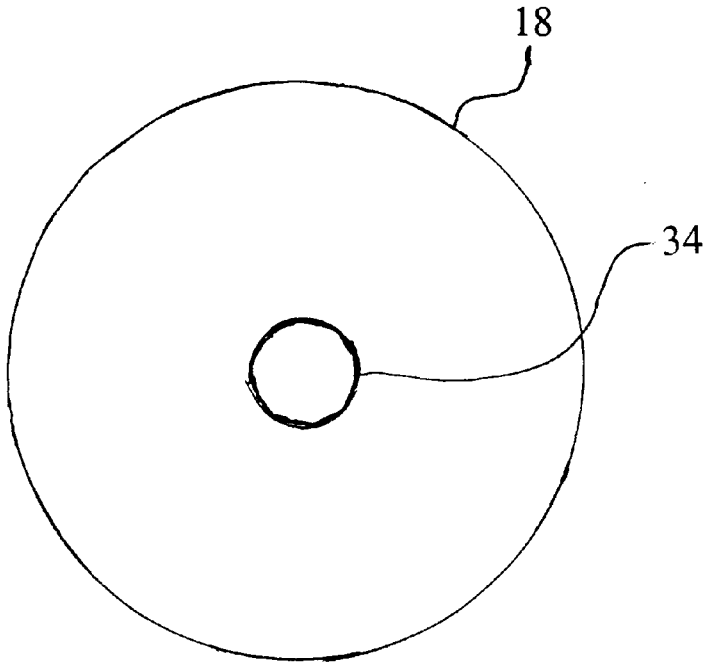
Figure 6:
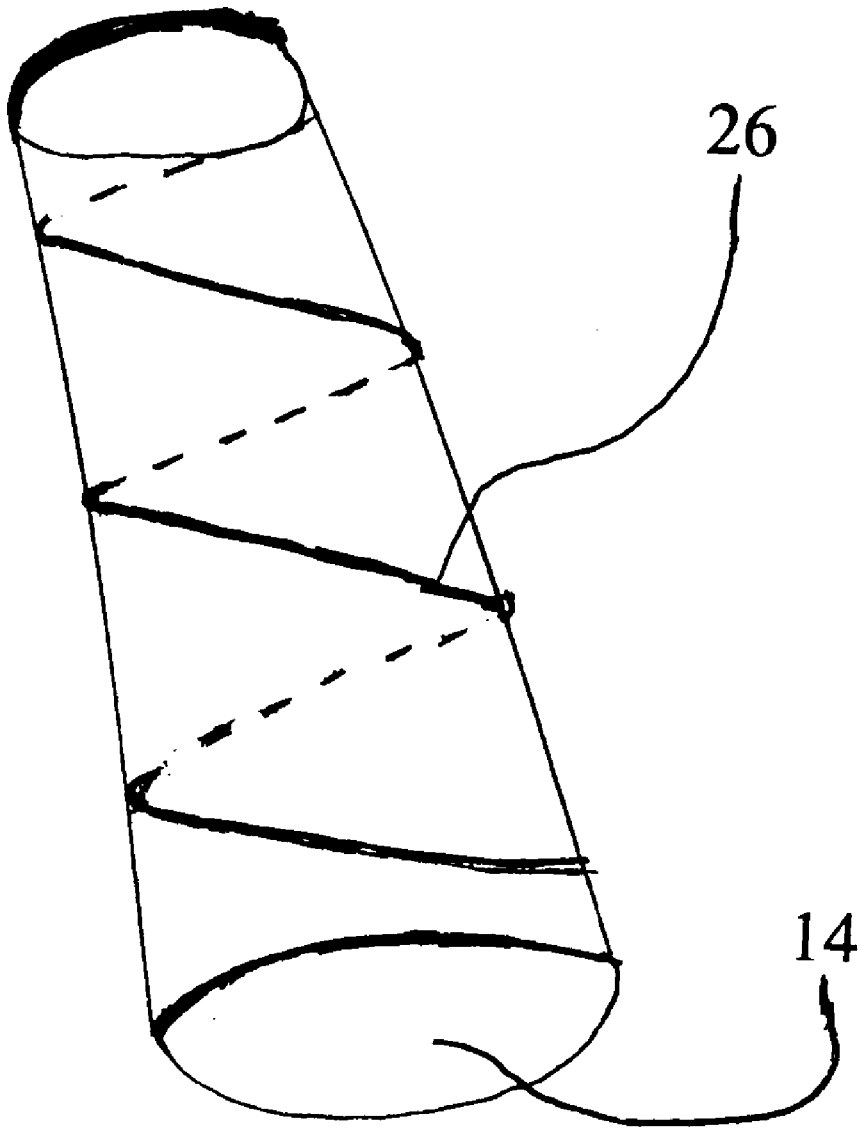
FIG. 6 shows a transparent side view of the internal helicoil.

| Peg Position | Plane of Motion | Peg Height | Degree of Motion |
|---|---|---|---|
| Recess 14A | Transverse | FIG. 4D 1 inch | 6 - 0 - 6 |
| | | FIG. 4E 2 inch | 10 - 0 - 10 |
| | | FIG. 4F 3 inch | 12 - 0 - 12 |
| Recess 14B and 14F | Frontal | FIG. 4A 1 inch | 6 - 0 - 6 |
| | | FIG. 4B 2 inch | 10 - 0 - 10 |
| | | FIG. 4C 3 inch | 12 - 0 - 12 |
| Recess 14D and 14H | Saggital | FIG. 4D 1 inch | 8 - 0 - 8 |
| | | FIG. 4B 2 inch | 16 - 0 - 16 |
| | | FIG. 4C 3 inch | 20 - 0 - 20 |

Although the description above contains many specificities, these should not be construed as limiting the scope of the invention but as merely providing illustrations of some of the presently preferred embodiments of this invention. For example, the platform can have other internal recesses added to bottom of the board to accommodate additional pegs; the platform attachment extensions can be enlarged to accommodate pegs of varying shape, such as trapezoidal, oval, rectangular, etc.; the imprinted angular measuring grid can be expanded or reduced with variations in platform size to decrease slippage of the fixed appendages.

Thus the scope of the invention should be determined by the appended claims and their legal equivalents, rather than by the examples given.

We claim:

1. An exercise device comprising:

a platform having an upper surface and a bottom surface with a center;

a generally cylindrical tilt peg having a rounded free end with a preselected curvature; and a tilt peg mount means positioned on the bottom surface at the center of the platform for releasably mounting the tilt peg to the platform with the free end exposed.

2. The exercise device according to claim 1 further including:

a stop peg having a preselected length and a free end; and a stop peg mount means positioned on the bottom surface at a peripheral edge of the platform for releasably mounting the stop peg to the platform with the free end exposed.

3. An exercise device comprising:

a platform having a generally rectangular shape with four corners, an upper surface and a bottom surface having a longitudinal axis and lateral axis meeting at a center of the bottom surface;

a generally cylindrical tilt peg having a rounded free end with a preselected curvature; and a generally cylindrical tilt peg mount means positioned on the bottom surface at the center of the platform for releasably mounting the tilt peg to the platform with the free end exposed.

4. The exercise device according to claim 3 further including:

a stop peg having a preselected length and a free end; and a stop peg mount means positioned on the bottom surface at a peripheral edge of the platform for releasably mounting the stop peg to the platform with the free end exposed.

5. The exercise device according to claim 4 wherein the stop peg mount means is positioned at a corner of the platform.

6. The exercise device according to claim 4 wherein the stop peg mount means is positioned along the longitudinal axis of the platform.

7. The exercise device according to claim 4 wherein the stop peg mount means is positioned along the lateral axis of the platform.

* * * * *